US010822005B2

(12) United States Patent
Weiss et al.

(10) Patent No.: US 10,822,005 B2
(45) Date of Patent: Nov. 3, 2020

(54) SUBMERSIBLE SWITCH POINT MACHINE

(71) Applicant: Twinco Manufacturing Co., Inc., Hauppauge, NY (US)

(72) Inventors: Walter W. Weiss, North Bellmore, NY (US); John Schatz, Commack, NY (US)

(73) Assignee: Twinco Manufacturing Co., Inc., Hauppauge, NY (US)

( * ) Notice: Subject to any disclaimer, the term of this patent is extended or adjusted under 35 U.S.C. 154(b) by 311 days.

(21) Appl. No.: 15/918,231

(22) Filed: Mar. 12, 2018

(65) Prior Publication Data

US 2019/0276059 A1 Sep. 12, 2019

(51) Int. Cl.

| | |
|---|---|
| ***B61L 5/06*** | (2006.01) |
| ***B61L 1/02*** | (2006.01) |
| ***B61L 1/20*** | (2006.01) |
| ***B61L 5/02*** | (2006.01) |

(52) U.S. Cl.

CPC ..... *B61L 5/065* (2013.01); *B61L 1/02* (2013.01); *B61L 1/20* (2013.01); *B61L 5/02* (2013.01)

(58) Field of Classification Search

CPC ..... B61L 1/02; B61L 1/20; B61L 5/00; B61L 5/02; B61L 5/06; B61L 5/065; B61L 5/067; B61L 5/10; E01B 7/00

See application file for complete search history.

(56) References Cited

U.S. PATENT DOCUMENTS 3,554,528 A * 1/1971 Kring ..... F16F 9/44 267/126
3,567,920 A * 3/1971 Campbell ..... B61L 1/165 246/249
3,621,237 A * 11/1971 Hylen ..... B61L 5/065 246/31
3,691,371 A * 9/1972 Hylen ..... B61L 5/06 246/393
3,702,396 A * 11/1972 Paulve ..... B61L 1/04 246/248
4,081,397 A * 3/1978 Booe ..... C08K 3/22 252/194

(Continued)

FOREIGN PATENT DOCUMENTS

DE 19705362 A1 8/1998
DE 19847126 A1 4/2000

OTHER PUBLICATIONS

Dvv Media International Ltd, "Low maintenece point operation—Railway Gazette", Feb. 1, 2002, XP055601123, Retrived from the Internet: URL:https://www.railwaygazette.com/news/single-view/view/low-mainteneace-point-operation.html.

(Continued)

*Primary Examiner* — Zachary L Kuhfuss
(74) *Attorney, Agent, or Firm* — Dilworth & Barrese LLP

(57) ABSTRACT

An improved switch point machine is provided which can seal out water, even if the machine itself becomes submerged. The operating rod and the point indicating rod that extend out of the switch box housing should be ground round and have a smooth surface for an improved seal. Those rods are preferably chrome plated. Dynamic hydraulic seals can be used to seal out moisture. Internal components, within the switch box housing, should also be sealed to be water resistant in the event water does enter the housing.

20 Claims, 6 Drawing Sheets

(56) References Cited

U.S. PATENT DOCUMENTS

| | | | | | |
|---|---|---|---|---|---|
| 4,501,429 | A * | 2/1985 | White | F16J 15/3404 | 277/317 |
| 4,921,189 | A * | 5/1990 | Callegari | B61L 5/10 | 246/344 |
| 5,806,809 | A * | 9/1998 | Danner | B61L 5/107 | 246/220 |
| 5,963,631 | A * | 10/1999 | Fazio | B61L 1/00 | 379/202.01 |
| 6,655,975 | B1 * | 12/2003 | Liedtke | H05K 5/064 | 439/276 |
| 7,168,530 | B2 | 1/2007 | Pomponio, Sr. | | |
| 8,336,831 | B2 | 12/2012 | Naquin | | |
| 2005/0178929 | A1 * | 8/2005 | Biagiotti | B61L 5/00 | 246/449 |
| 2008/0290223 | A1 * | 11/2008 | Sargis | B61L 5/02 | 246/278 |
| 2010/0072327 | A1 * | 3/2010 | Song | A63H 19/32 | 246/415 A |
| 2015/0016001 | A1 * | 1/2015 | Quirk | H02H 5/083 | 361/78 |
| 2018/0093682 | A1 * | 4/2018 | McQuistian | B61L 5/06 | |
| 2019/0276059 | A1 * | 9/2019 | Weiss | B61L 1/20 | |

OTHER PUBLICATIONS

Invitation to pay additional fees and International Search Report and in Partial provisional opinion accompanying partial search results dated Jul. 19, 2019.

* cited by examiner

SUBMERSIBLE SWITCH POINT MACHINE

TECHNICAL FIELD

The present disclosure relates generally to rail switches and more particularly to a weather resistant enclosed machine for operating the switch points of a train rail switch.

BACKGROUND

Switching systems are critical for proper railroad operation. The switch points of a rail switch, sometimes referred to as a turnout, is a movable section of track used to direct a train from one line to another, by moving a section of track between two positions: a first for directing a train down one track and a second for directing a train down a second track.

Switches used to be operated manually, with a lever, cables and other linkages, to move the switch points between the two tracks. Today, most switches are operated automatically, with a switch point machine, which receives electric control signals. Typical switch point machines employ an electric motor to drive an operating rod between the two selected positions, and a mechanism to lock the operating rod and switch points in place, to prevent unintentional dislocations.

Switch point machines (also referred to herein as switch machines) are often subjected to severe conditions. Switch point machines are primarily located outdoors and mounted at ground level. They are typically subject to seasonal weather, flooding, ice, and so forth. Electrically operated switch machines utilize an electric motor and electric switches having electrical contacts. Water, moisture, electrical contacts and electricity can be incompatible. The electrical contacts in a switch point machine are needed to operate the motor and to indicate the status of the switch point machine's state, e.g., whether it is locked and whether the switch points are closed within specification. Therefore, the indicating contacts can provide vital feedback to a signal system to indicate whether it is safe to allow train traffic over the switch points.

Conventional switch point machines have electric motors that are not sufficiently sealed against water and moisture entry. Conventional switch point machine contacts are inside an unsealed housing and often require maintenance intervention to prevent or mitigate corrosion or ice buildup. Water and excessive moisture compromise reliability by causing corrosion, which impedes mechanical and electrical function. Water can also compromise reliability in freezing weather. Ice can impede movement of mechanisms. Also, ice on electrical contact surfaces prevents continuity or prevents opening and/or closing of electrical contacts. Therefore, a switch point machine designed to prevent entry of water and/or moisture and having all electrical connections submersibly sealed, offers a substantial reduction if not elimination of the above mentioned failure points, thereby leading to substantially improved reliability.

It is clear that many transit delays are attributed to switches and signal failures during bad/cold weather. Switch point machines are commonly subjected to rain and snow and some are subjected to flooding, even flooding with salt water. However, conventional switch point machines do not adequately protect their components from the most severe conditions.

Accordingly, an improved switch point machine is desired, which overcomes the deficiencies of the prior art.

SUMMARY OF THE INVENTION

Generally speaking, in accordance with the invention, an improved switch point machine is provided which can seal out moisture and/or water, even if the machine itself becomes submerged. Preferred embodiments of the invention can be made sufficiently watertight to prevent any entry of moisture or liquid water, even if submerged for 24 hours, 48 hours, or longer, including water 1 foot, 5 feet or even 10 feet or more above the top of the machine housing.

The motor is preferably a sealed submersible design, incorporating a dynamic radial seal on the externally extending shaft to which the internal drive gear is mounted, the body assembly is preferably statically sealed with o-rings, the electrical connector is preferably sealed to the body with an O-ring and the mating connector makes it a sealed watertight submersible electrical connection.

A switch point machine housing in accordance with the invention can contain an internal junction box, inside which electrical connections are made between the external connector and the internal electrical components, e.g., the motor, disconnect switches, and indicating switches. The internal junction box can be sealed to the housing with an o-ring. The electrical power and signal cables can enter the internal junction box through sealed watertight submersible cord grips. The electrical connectors on the internal junction box should be statically sealed to the internal junction box with o-rings. The mating connector can provide a sealed watertight submersible electrical connection.

The housing cover can be removable and should incorporate a compressible sealing element (e.g., closed cell silicone cord). In another embodiment of the invention, the seal can be attached to the housing, where it meets the cover. The housing cover should incorporate compression limiting elements to avoid over-compression of the seal which can damage the seal and reduce sealing effectiveness. The compression limiting elements also allow the attachment hardware to be torqued to the full recommended value. That can reduce the possibility of loosening in what can be a high-vibration environment.

The external surface of the operating rod (also referred to as the pull rod or connecting rod) and the point indicating rod should be ground to a smooth finish. It should have a round shape and is preferably plated, especially chrome plated. Finishes similar to the shaft of a hydraulic piston are preferred. Furthermore, internal components, within the outer housing, should also be sealed to be water resistant in the event water does enter the housing. The seal material for the operating rod should be chosen for its ability to dynamically seal and have a long wear life (wear of the seal and of the shaft). Elastomers, such as polyurethane rubbers are preferred.

The switches used internally should be sealed against moisture and should incorporate positive opening contacts, to prevent false signals, in the event the switch contacts become welded. A dynamic hydraulic seal should be used to seal the operating rod and the point indicating rod. The operating rod should lock when it reaches the end of its movement, so that there is no need to keep the motor under power.

It is also preferable to keep desiccant material inside the switch point machine housing box, in case small amounts of moisture enter unintentionally. It is also preferable to include a moisture indicator to provide an alert that the desiccant needs to be changed and/or that moisture should be removed from inside the housing.

Other embodiments of the invention will be apparent from the drawings and the specification to follow and the scope of the invention will be indicated in the claims.

BRIEF DESCRIPTION OF THE DRAWINGS

The present disclosure will become more readily apparent from the specific description accompanied by the following drawings, in which.

Throughout the disclosure, like reference numerals will be used to indicate similar elements.

DETAILED DESCRIPTION OF PREFERRED EMBODIMENTS

The present disclosure may be understood more readily by reference to the following detailed description, taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments, by way of example only, and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. In particular, they are intended to refer to the spatial reference of the display stand in its normal, assembled configuration during intended use.

Figure 1:
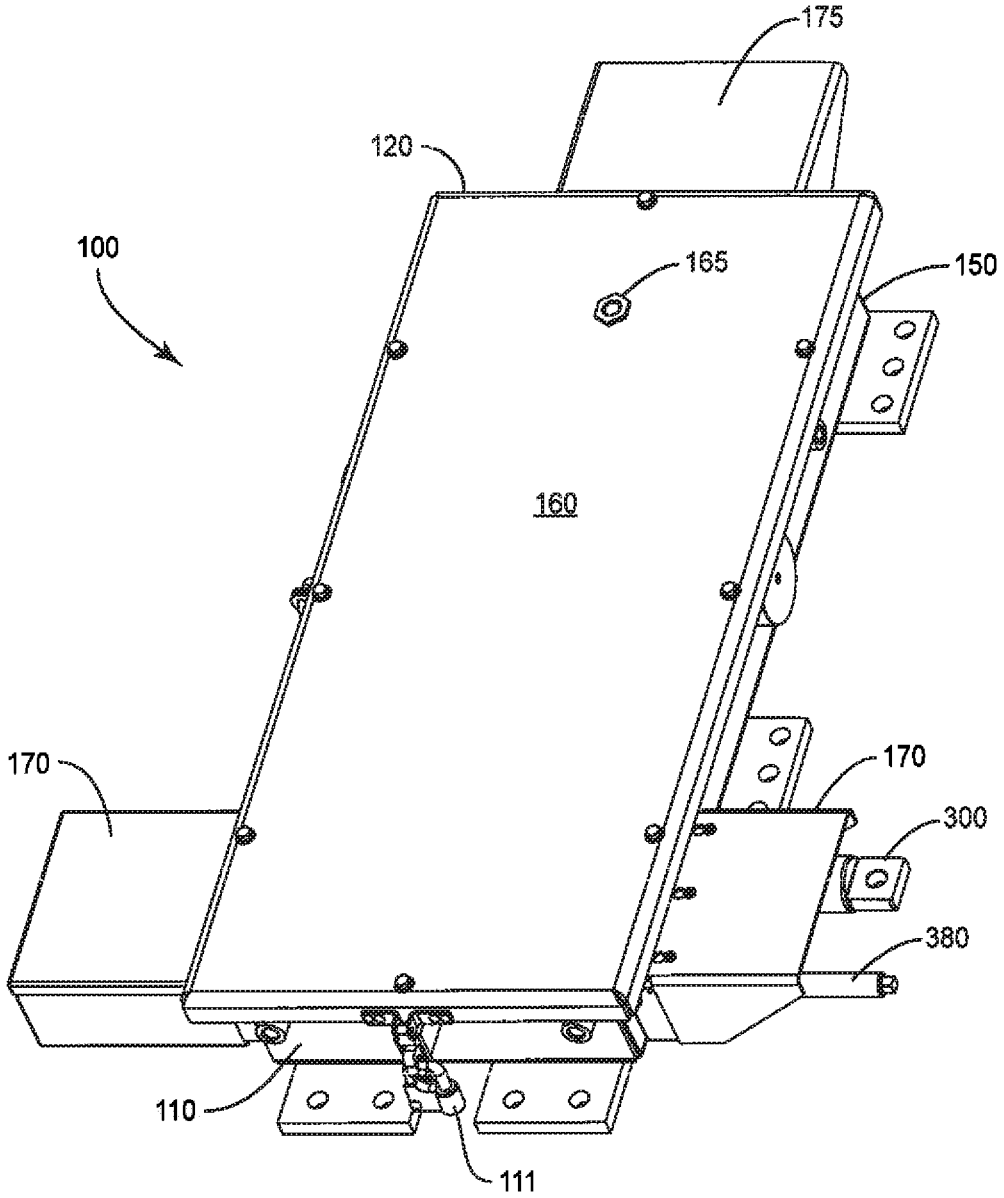
FIG. 1 is a perspective view of a switch point machine, constructed in accordance with a preferred embodiments of the invention.

A machine for activating a train rail switch by moving the switch points of a railway system by positioning the switch points at a selected location, typically at the end points of one of two locations, to join it to one of two different tracks, is shown generally as switch point machine 100 in FIG. 1. Switch point machine 100 includes a switch box housing 150 having a cover or lid 160. A moisture detection signal 165 on the outside of housing 150 can indicate whether any moisture exists within housing 150, and provide an alert, if a high humidity condition need to be addressed. A front side 110 of housing 150 can include a lock 111.

An operating rod 300 drives the switch points of the rail switch. In response to control signals, operating rod 300 oscillates laterally with respect to housing 150, generally between two specific end point locations, one fully extended and the other, fully retracted. Operating rod 300 is protected by a rod shield 170. A switch point detection rod 380 also extends laterally out of housing 150. Switch point detection rod 380 can move laterally independently with operating rod 300. Switch point detection rod 380 follows the switch point movement and detects the switch point positions during track switching.

Figure 9:
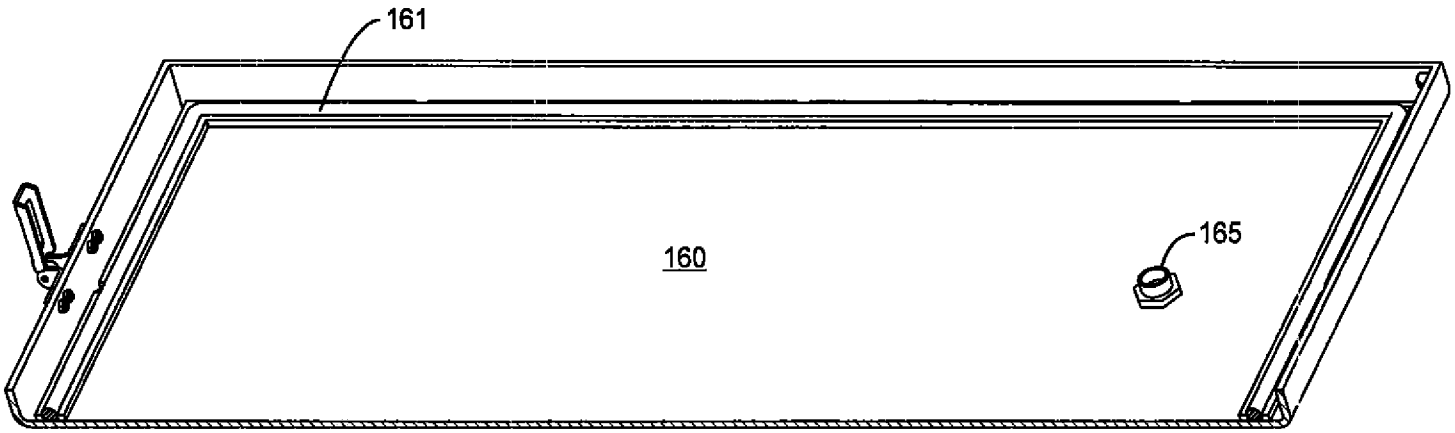
FIG. 9 is a cross sectional perspective view of the underside of the cover of the switch point machine of FIG. 1.

An electrical connector shield 175 is located on a rear wall 120 of housing 150. Shield 175 helps protect any power and signal lines entering housing 150 at an electrical connector (not shown) in rear wall 120. Housing 150 also includes a sealed cover lip or ledge 125. The underside of lid 160 is shown in FIG. 9. The periphery of the underside of lid 160 includes a compressible seal 161, arranged to abut ledge 125 to form the seal at ledge 125. Seal 161 is preferably formed of elastomeric material, such as silicone, preferably closed cell silicone foam. Other non-silicone elastomers, preferably other closed cell foams are acceptable.

Sealed cover ledge 125 helps prevent the penetration of water, moisture and dust. All openings of housing 150 should be equipped with watertight seals.

Figure 2:
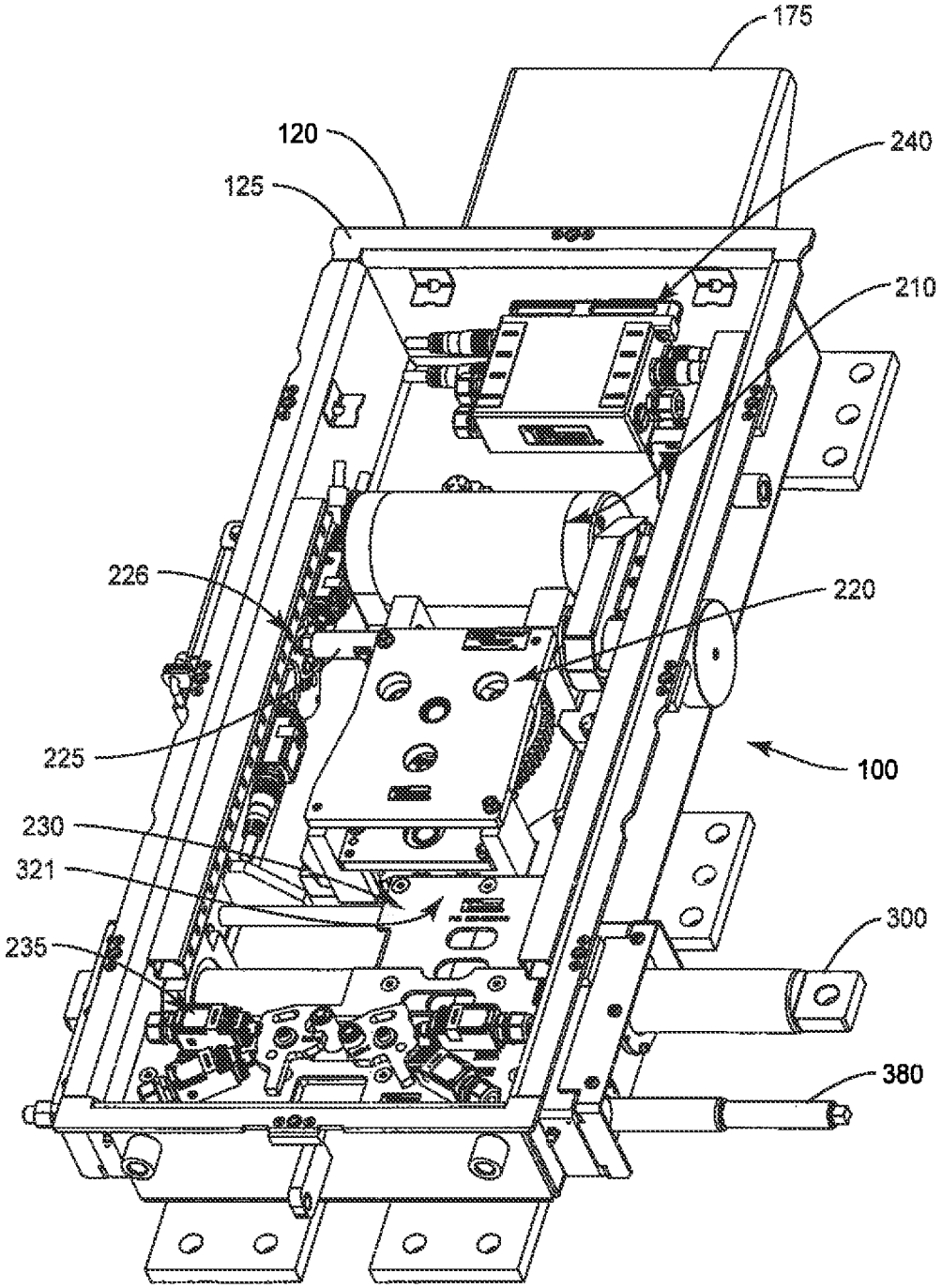
FIG. 2 is a perspective view of the switch point machine of FIG. 1, with the top-cover removed.

Referring to FIG. 2, switch point machine 100 receives both electric power and control signals via an electrical connector 240, coupled to a powerline and a signal line (not shown). Electrical connector 240 comprises an electrical box, which is sealed against water and/or moisture intrusion and penetration. It is important that power is supplied to the motor via a watertight electrical connector or connection. Power received at connector 240 is provided to an electric motor 210. Electric motor 210 provides force, to drive a gearbox 220. Gearbox 220 provides the throw force for driving operating rod 300.

A gearing system of switch point machine 100 includes reduction gears for reducing speed and increasing torque. Gearbox 220 includes an adjustable torque-limiting clutch that can slip, for example, when the switch is activated but the switch points are blocked, obstructed or deformed. The clutch promotes reliable operation by limiting the forces that the motor and gear train are exposed to due to motor inertia as the motor decelerates at the end of each stroke, or due to an obstruction during a move, or external forces from switch point movements. A worm shaft 225 is coupled to a hand crank fitting 226, to permit hand operation of switch point machine 100 by attaching a hand crank to fitting 226. The transmission system of switch point machine 100 also includes a gear rack 321, which converts rotational movement of the gearbox into linear movement of operating rod 300.

Switch point machine 100 also includes a control mechanism 230. Control mechanism 230 receives force from gearbox 220 and moves, locks and unlocks operating rod 300. In particular, control mechanism 230 locks operating rod 300 at its endpoints, e.g., the two positions of the switch, so that operating rod 300 can be maintained at its endpoints without the need to keep switch point machine 100 in a powered condition.

Control mechanism 230 also ensures that a pair of point detection switches 235 can only be activated when the switch points are in correct end positions. Point detection switches 235 indicate the correct locking end point of operating rod 300. A switch mounting plate 315 provides for mounting of point detection switches 235 at selected precise location to ensure proper detection.

Figure 3:
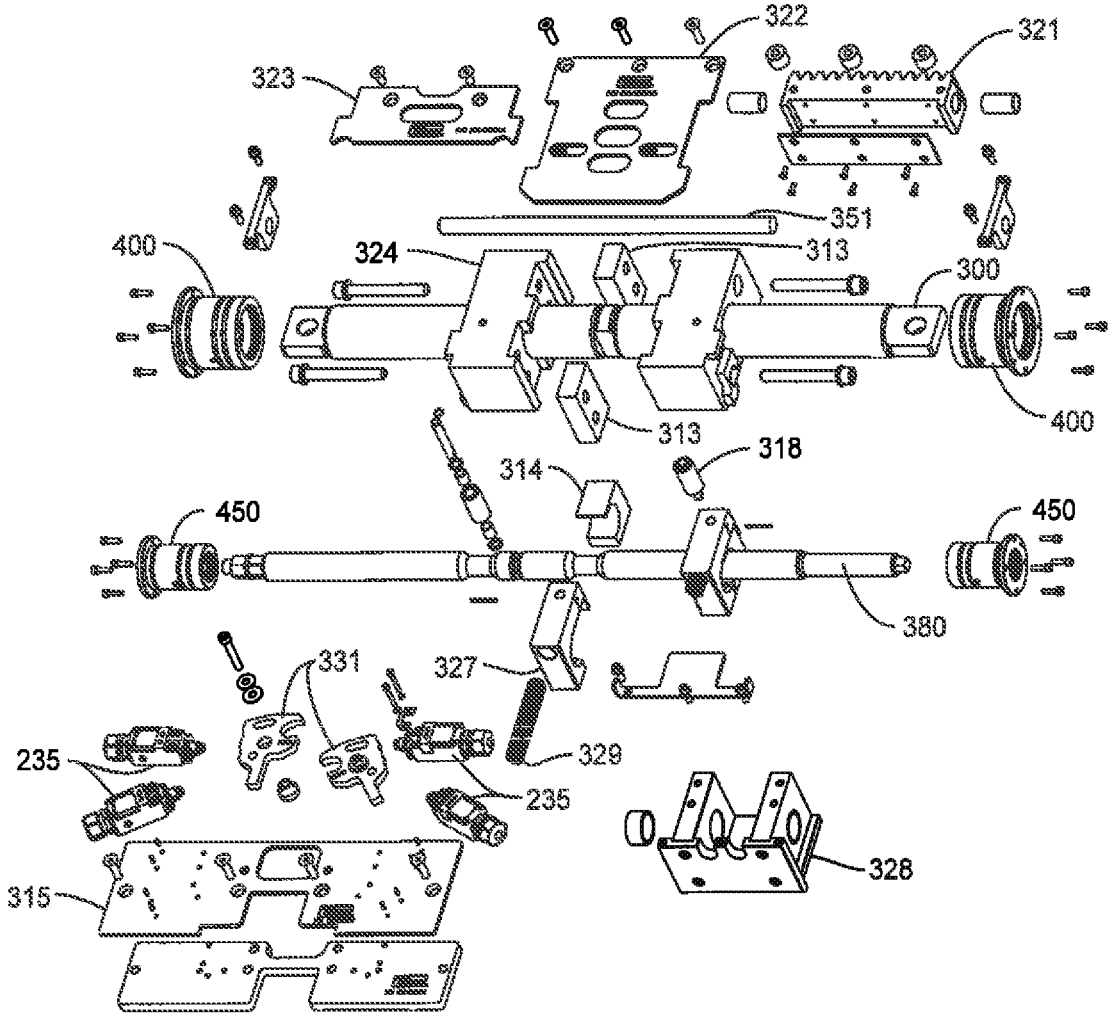
FIG. 3 is an exploded view of the control mechanism of the switch point machine of FIG. 1.
Figure 4:
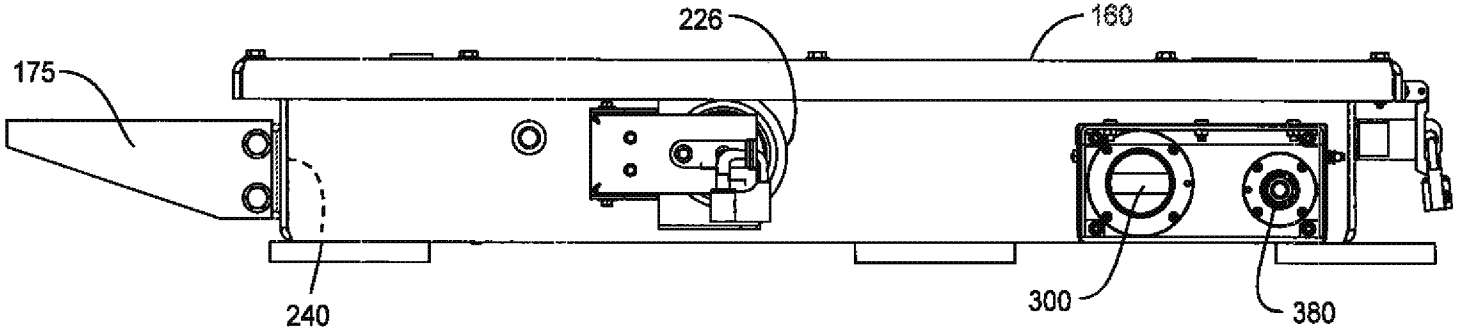
FIG. 4 is a side view of the switch machine of FIG. 1.
Figure 5:
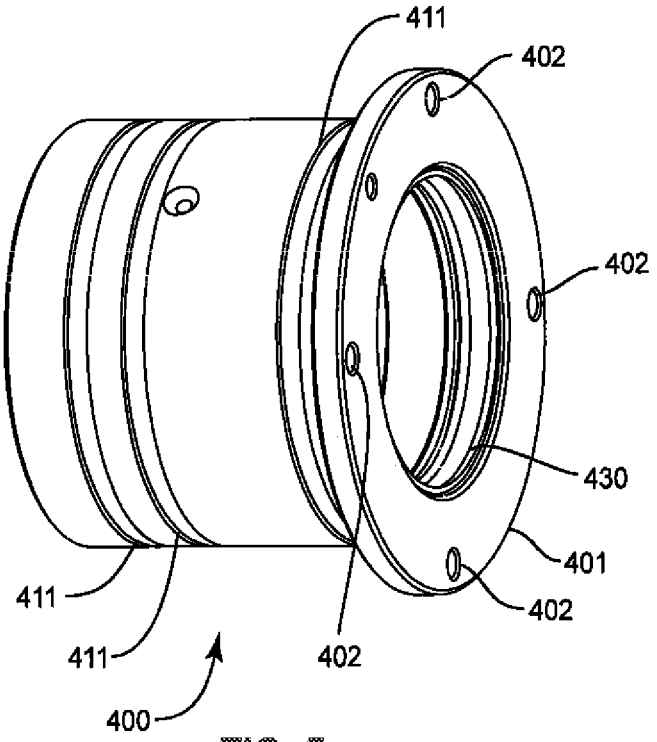
FIG. 5 is a perspective view of a seal for an operating rod of the switch point machine of FIG. 1.
Figure 6:
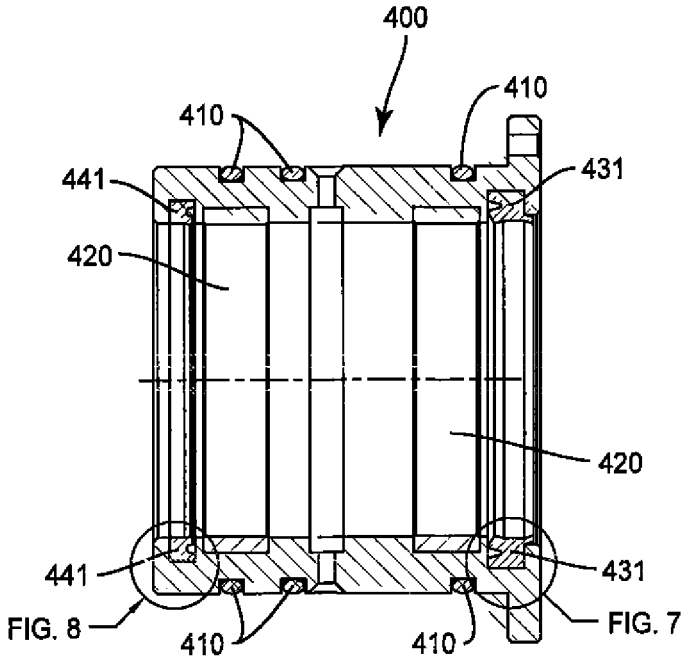
FIG. 6 is a cross-sectional view of the seal of FIG. 5.
Figure 7:
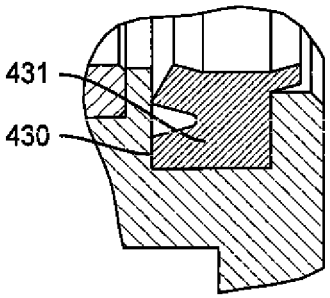
FIG. 7 is an enlarged cross-sectional view of a portion of the seal of FIG. 5.
Figure 8:
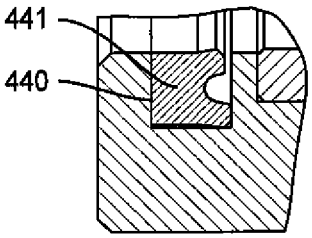
FIG. 8 is an enlarged cross-sectional view of another portion of the seal of FIG. 5.

Referring to FIG. 3, electric motor 210 drives a gear rack 321, which rides on a gear rack guide 351. Gear rack guide 351 serves as a linear guide for gear rack 321. Gear rack 321 is coupled to and transmits drive force to an operating block 324 on operating rod 300 to drive operating rod 300 laterally between the two switch points. A key 313 secures operating rod 300 to operating block 324 and protects against excessive forces. An operating cam 322 is fixed to gear rack 321 and a top cam plate 323 is fixed to the operating block 324 Consequently, gear rack 321 also moves operating cam 322 and top cam plate 323.

Operating cam 322 controls locking and unlocking of operating block 324 and operating rod 300, by moving a locking latch body 327 and a lock dog 314. Lock dog 314 locks operating block 324 and operating rod 300 in place, independent of point position confirmation. Operating cam 322 acts against a cam roller 318 fixed to locking latch body 327. Operating cam 322 pushes locking latch body 327 into a lock/detection housing 328 and unlocks lock dog 314. This causes point detection switches 235 to indicate (signal) unlocking. Thus, activation of point detection switches 235 only occurs when operating block 324 is in the proper position.

Locking latch body 327 follows cam 322 and detector rod 380. Locking latch body 327 positions lock dog 314 to lock and unlock operating block 324 and operating rod 300 in its end positions. Cam roller 318 runs in camming engagement against operating cam 322 and top cam plate 323. It thereby controls and transmits the position of locking latch body 327, lock dog 314 and a switch trigger cam 331. The two-part execution helps ensure that when operating block 324 is locked, that end point detection switch 235 indicates (signals) unlocking.

Point detection rod 380 is a two-part rod. It moves load-free, with movement of operating rod 300. It follows the point position of the rail switch (not shown), as switch point machine 100 is activated. Point detection rod 380 prevents activation of point detection switches 235 when the switch points are not closed. Point detection rod 380 will control indication, but does not affect locking.

A lock detection housing 328 guides locking latch body 327 and lock dog 314. A locking spring 329 pushes locking latch body 327 against cam 322 and detection rod 380. Locking spring 329 also urges lock dog 314 into a locking position. As operating block 324 moves into an end position against a stop, lock dog 314 is pushed by spring 329 out of lock/detection housing 328 and locks operating block 324. Thus, spring 329 acts against locking latch body 327. The position of locking latch body 327 is controlled by cam roller 318 and operating cam 322. The position of latch body 327 controls lock dog 314 which locks operating block 324 if operating block 324 has reached its final position.

Movement of locking latch body 327 moves a switch trigger cam 331, which actuates point detection switches 235 and signals locking, based on the correct position of point detection rod 380. Point detection switches 235 can only be activated when operating rod 300, detection rod 380 and lock dog 314 are in correct relation to each other.

Point detection switch 235 indicates whether the rail switch point is closed and locked. Both switch positions (activated and not activated) are indicated. Point detection switches 235 should be restraint-guided safety switches. Undefined switch positions are therefore, not possible. The switch indication, in combination with the operator provided switching and signaling system and proper maintenance, is used to confirm proper operation and to detect errors with and damage to switch point machine 100 and/or the switch points.

Operating cam 322 moves against cam roller 318 of locking latch body 327 and pushes locking latch body 327 into a lock detection housing 328 to unlock locking dog 314. At this point, point detection switch 235 signals unlocking. Gear rack 321 moves operating block 324 into which operating rod 300 is firmly mounted, so that it does not twist. Operating block 324 moves into position against a stop. Lock dog 314 is pushed by spring 329 out of lock detection housing 328 and locks operating block 324. Cam roller 318 of locking latch body 327 moves switch trigger cam 331, which operates point detection switch 235 and signals locking, when point detection rod 380 is in a proper position.

Operating rod 300 exits from switch box housing 150 to move laterally and position the rail. Point detection rod 380 also exits from housing 150 to move with operating rod 300. Accordingly, it is important to provide an effective, weather and submersion proof dynamic hydraulic seal, as an operating rod bearing housing 400. A similar, but smaller housing and seal is provided as a point detection rod housing and seal 450. Operating rod housing and seal 400 and point detection rod housing and seal 450 guide and seal the openings in housing 150 from any water or moisture that could enter housing 150 at the locations where operating rod 300 and point detection rod 380 exit housing 150.

Operating rod housing and seal 400 is shown in greater detail in FIGS. 5-8. Housing 400 includes a flange 401 having four openings 402 for receiving screws or bolts to hold housing 400 tightly against an opening in housing 150. O-rings 410 are provided in a ring groove 411 of housing 400. O-rings 410 are static hydraulic seals and prevent any liquid or moisture from entering past the outside of operating rod housing 400.

The interior of operating rod housing 400 includes a pair (or one or more than two) wear rings 420, which contact operating rod 300 to act as a linear bearing, controlling the radial position of the rod and bearing radial loads as it moves axially, with respect to housing 400. A mouth groove 430 of housing 400 receives a double-lip wiper ring 431, formed of a durable and pliable elastomer such as polyurethane material. Wiper ring 431 serves as an outer dynamic hydraulic seal, to prevent moisture from entering housing 150, including when operating rod 300 moves into housing 150, in the course of activating the rail switch. Acceptable wiper rings are made from elastomers, such as polyurethane material. Acceptable wiper rings are available from Hi Tech Seals, Edmonton Alberta. A rod seal 441 is present in a housing tail groove 440. Rod seal 441 is a dynamic hydraulic seal, made of durable elastomeric material. Acceptable rod seals are made from synthetic rubber and rubber copolymers and are available from American High Performance Seals, Oakdale, Pa.

In one embodiment of the invention, at least one of the wiper rings is an H style wiper, which has two lips that contact the rod, with a U shaped cup therebetween. This construction can act as a secondary rod seal and provides a reduction in apparent rod seal leakage, while maintaining equivalent ingression resistance to a sharp lip wiper. Synthetic rubbers having high resistance to compression set, tear, and abrasion resistance are preferred.

Operating rod 300 is preferably ground to an extremely smooth, consistent, circular diameter and coated or plated, in order to provide an extremely smooth, defect-free finish, to ensure exceptional sealing by seals 431 and 441. The coating or plating should be corrosion resistant. The smooth uniform finish helps minimize wear and ensures longer life dynamic sealing. A finish characteristic of hydraulic/pneumatic pistons, ground, plated and polished material is preferred. The finish should be 3-12 μin. A finish smoother than 3 μin can be unsuitable for adequate lubrication of the mating surfaces and rougher than 12 μin can act like a file against the seals. Chrome plating is a preferred material.

Constructions in accordance with the invention can remain water-tight even when submerged for 24 hours, 48 hours or even a week or longer. Housing 400 and seals 431 and 441 can prevent the entry of water at least 1, preferably 5 and even 10 or more feet above the upper portion of housing 150 or 400 for an hour or more. For example, a preferred embodiment of the invention can seal out water 1 foot or more above the top of housing 150 for at least 1 hour, preferably 24 hours, more preferably 48 hours and most preferably one week or more. Other preferred embodiments of the invention can seal out water 5 feet or more above the top of housing 150 for at least 1 hour, preferably 24 hours, more preferably 48 hours and most preferably one week or more. Still other preferred embodiments of the invention can seal out water 10 feet or more above the top of housing 150 for at least 1 hour, preferably 24 hours, more preferably 48 hours and most preferably one week or more. A similarly effective housing is disposed at the junction of point detection rod 380 and housing 150.

Indicating rod 380 should be sealed in a similar manner as operating rod 300, to prevent water from entering housing 150. Indicating rod 380 can comprise two O-rings to seal the inner shaft of rod 380. The outer portion of rod 380 can be sealed by the bushing/seal housing assemblies in an equivalent manner to the sealing structure of operating rod 300, with the dimensions adjusted.

Indicating rod 380 has two halves, connected by a threaded connection. A rotating the sleeve adjusts its length as its endpoint moves along the axis, making the assembly longer or shorter, which shifts the actuation position independently for both switch points. This adjustment allows precise threshold adjustment for indicating an obstruction or gap between the switch point and the adjacent running rail. A common open point indication threshold is ¼ inch. A gap less than ¼ inch can indicate as "point closed," i.e., safe for traffic over switch points. A gap ¼ inch or larger can indicate point open, no traffic permitted over switch points.

Switch point machines in accordance with alternate embodiments of the invention might not have an indicating rod and those housings and openings would be absent or sealed with a plug. The indicating switches could still operate, based on operating cam 322 and operating block 324, providing indication that the operating rod reached the end position. Note, however, that this configuration is less safe than having a separate point indication rod. The switch point machine may still indicate it reached the end position. However, it has no way to detect if the operating rod becomes detached from the switch points or if the switch points become damaged.

Note that where this application has listed the steps of a method or procedure in a specific order, it may be possible, or even expedient in certain circumstances, to change the order in which some steps are performed, and it is intended that the particular steps of the method or procedure claim set forth herebelow not be construed as being order-specific unless such order specificity is expressly stated in the claims.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A switch point machine for moving a rail switch between at least two positions, comprising:

a water and moisture tight switch box housing having an outside surface, an inside region, a left side and a right side opposite the left side, and an electrical connector on the outside surface, the electrical connector adapted to receive electric power and control signals and transmit the electric power and control signals into the interior of the housing;

an operating rod extending out of the left side and the right side of the switch box housing through a left side and a right side operating rod housing, each operating rod housing having dynamic hydraulic seals, the operating rod configured to attach to and move a rail switch, the portion of the operating rod extending through the seals having a round cross section and a smooth surface;

an electric motor within the switch box housing interior mechanically coupled within the interior to the operating rod and electrically coupled within the interior to the electrical connector and adapted to move a portion of the operating rod through the left side and the right side operating rod housings, into and out of the left side and right side of the switch box housing;

wherein the switch box housing, operating rod housing, and electrical connector are effective to seal water from the switch box housing interior for 24 hours if the switch box housing is submerged under 1 foot of water.

2. The switch point machine of claim 1, wherein the switch box housing and operating rod housing and seals are effective to seal out water if the switch box housing is submerged under 1 foot of water for 48 hours.

3. The switch point machine of claim 1, wherein the switch box housing and operating rod housing and seals are effective to seal out water if submerged more than 5 feet above the seal for 1 hour.

4. The switch point machine of claim 1, wherein at least the portion of the operating rod extending through the left and the right operating rod housings is chrome plated.

5. The switch point machine of claim 1, wherein the operating rod housings each comprise a double-lip wiper seal.

6. The switch point machine of claim 5, wherein the wiper seals comprise polyurethane material.

7. The switch point machine of claim 5, wherein the operating rod housings each comprise a second seal inward from the wiper seal.

8. The switch point machine of claim 1, wherein there is at least one O-ring sealing the joinder of the outside of the operating rod housings to the switch box housing.

9. The switch point machine of claim 1, wherein at least a portion of the operating rod extending through the left and the right operating rod housings has a smooth surface polished to a smoothness of 3-12 μin.

10. The switch point machine of claim 1, wherein the switch box housing includes a lid that closes against a lip and a compressible hydraulic seal is present at the interface of the lip and the lid and the lid includes a compression limiting element adapted to avoid over-compression.

11. The switch point machine of claim 1, comprising a point detection rod extending out of the left side and the right side of the switch box housing through a detection rod housing having dynamic hydraulic seals to resist the entry of moisture into the switch box housing interior through the detection rod housings, the point detection rod configured and arranged to move into and out of the right side and left side of the switch box housing with the operating rod and the portion of the point detection rod extending through the seals having a round cross section and a smooth surface.

12. The switch point machine of claim 11, wherein the portion of the point detection rod extending through the detection rod housing and the portion of the operating rod extending through the operating rod housing have the smooth surface of the shaft of a hydraulic piston.

13. A switch point machine, comprising:

a housing box having a bottom, sides, including a left side and a right side, a lid and a compressible moisture tight seal is between the lid and the sides, the bottom, sides and lid defining an interior;

an electrical connector joined to the housing box and adapted to receive electric power and transmit the power from outside the housing box, into the interior of the housing box, the connector having a moisture tight seal at the juncture of the connector to the housing box;

a motor within the housing box interior, electrically coupled to the electrical connector, the motor sealed to resist entry of moisture;

an operating rod operatively coupled to the motor within the interior of the housing box, the operating rod extending through an operating rod opening through the left and right sides of the housing box, the operating rod openings having a dynamic hydraulic seal to prevent moisture from entering the housing box interior between the operating rod openings and the operating rod and the surface of the operating rod extending through the operating rod opening having a smooth surface;

wherein the housing box is adapted to resist the entry of moisture therein when submerged under 5 feet of water for 24 hours.

14. The switch point machine of claim 13, wherein there are switches within the switch box housing and those switches are sealed to be water resistant.

15. The switch point machine of claim 14, wherein the switches within the switch box housing have positive opening contacts and are adapted to prevent false signals, in the event the switch contacts become welded.

16. The switch point machine of claim 13, wherein the coupling of the operating rod to the motor is constructed and arranged to lock when the operating rod reaches an end position at the end of movement and the motor does not need to be powered to maintained the operating rod in the end position.

17. The switch point machine of claim 13, wherein there is desiccant material inside the switch box housing.

18. The switch point machine of claim 13, wherein there is a moisture indicator on the switch box housing to indicate whether there is moisture within the switch box housing.

19. The switch point machine of claim 13, comprising a point detection rod extending out of a the left side and the right side of the switch box housing through a detection rod opening, each opening having a dynamic hydraulic seal to resist the entry of moisture into the switch box housing through the detection rod openings, the point detection rod configured and arranged to move into and out of the switch box housing with the operating rod and the portion of the point detection rod extending through the detection rod opening having a round cross section and a smooth surface.

20. The switch point machine of claim 19, wherein the portion of the point detection rod extending through the detection rod openings and the portion of the operating rod extending through the operating rod openings both having a smoothness of 3-12 μin.

* * * * *